United States Patent [19]

Grohoski

[11] 4,118,965

[45] Oct. 10, 1978

[54] DIE MOUNTING ASSEMBLY FOR A PLANETARY WORK FORMING MACHINE

[75] Inventor: Edward Gregory Grohoski, Litchfield, Conn.

[73] Assignee: The Hartford Special Machinery Company, Simsbury, Conn.

[21] Appl. No.: 817,668

[22] Filed: Jul. 21, 1977

[51] Int. Cl.[2] ..... B21B 31/02

[52] U.S. Cl. ..... 72/102; 29/129; 29/148.4 D

[58] Field of Search ..... 29/148.4 D, 117, 129; 72/102

[56] References Cited

U.S. PATENT DOCUMENTS

| | | | |
|---|---|---|---|
| 2,835,518 | 5/1958 | Naab | 29/148.4 D |
| 3,803,691 | 4/1974 | Geese et al. | 29/148.4 D |

*Primary Examiner*—Lowell A. Larson

*Attorney, Agent, or Firm*—Prutzman, Hayes, Kalb & Chilton

[57] ABSTRACT

An assembly is disclosed for quick and easy mounting and removal of a circular die in coaxial surrounding relation to a machine spindle and which features a one-piece diametrically expandable sleeve concentrically interposed in wedged engagement between the spindle and die and a bi-directional displacement means which includes a jack plate in overlying stacked relation to the spindle for driving the sleeve in opposite axial directions toward and away from an operating position, the operating position of the sleeve being in wedged engagement between the spindle and die to remove clearances therebetween and to promote concentricity of the circular die.

8 Claims, 3 Drawing Figures

DIE MOUNTING ASSEMBLY FOR A PLANETARY WORK FORMING MACHINE

FIELD OF THE INVENTION

This invention generally relates to planetary work forming machines and particularly concerns a die mounting assembly for use with an axially rotatable machine spindle.

BACKGROUND OF THE INVENTION

Of the various types of thread rolling machines in commercial use, several use one or more dies of cylindrical shape, commonly called "circular dies." Planetary thread rollers use a single circular die that rotates continuously about a fixed axis, plus one or more stationary, concave shaped die segments located adjacent the periphery of the rotating die. There are two other basic types of thread rolling machines using cylindrical dies: one having two dies mounted diametrically opposite each other, and the other equipped with three equally spaced, parallel axis, cylindrical dies. In all these machines the circular dies, being perishable tooling, must be mounted and removed from the machines at intervals. The problems involved are common to all the above-mentioned classes of machines.

This invention is concerned with the means provided for mounting a circular die on the machine spindle. Thread rollers manufactured heretofore commonly provided a simple clearance fit with a driving key between the die and the spindle. Even though close manufacturing tolerances are observed, the cyclical nature of the load in thread rolling inevitably causes fretting corrosion between die and spindle. It is a serious problem and results in hours spent (literally) in the frustrating job of removing the die from its spindle. Fretting corrosion also produces gradual destruction of both surfaces as is well known.

OBJECTS OF THE INVENTION

The primary object of this invention is to provide a new and improved removable circular die mounting assembly which preserves and even enhances precise concentricity of the circular die while at the same time removes clearances between the die and machine spindle, and eliminates any minor radial distortion of the die.

Another object of this invention is to provide such a die mounting assembly which is economically manufactured and is quick and easy to install and disassemble.

Other objects will be in part obvious and in part pointed out more in detail hereinafter.

SUMMARY OF THE INVENTION

As a solution to the foregoing problems, this invention provides a convenient assembly for removing all clearances between the die and the spindle. The assembly provides a bi-directional displacement means including a hardened steel wedging sleeve, accurately made with a tapered inside diameter and a cylindrical outside diameter, and a jack plate. The jack plate is mounted in stacked overlying relation to the spindle in driving engagement with the sleeve for moving the sleeve as a unit in opposite directions toward and away from an operating position in concentrically interposed wedged engagement between the spindle and the surrounding circular die.

A better understanding of this invention will be obtained from the following detailed description and the accompnaying drawings of an illustrative application of the invention.

DETAILED DESCRIPTION OF A PREFERRED EMBODIMENT

Figure 1:
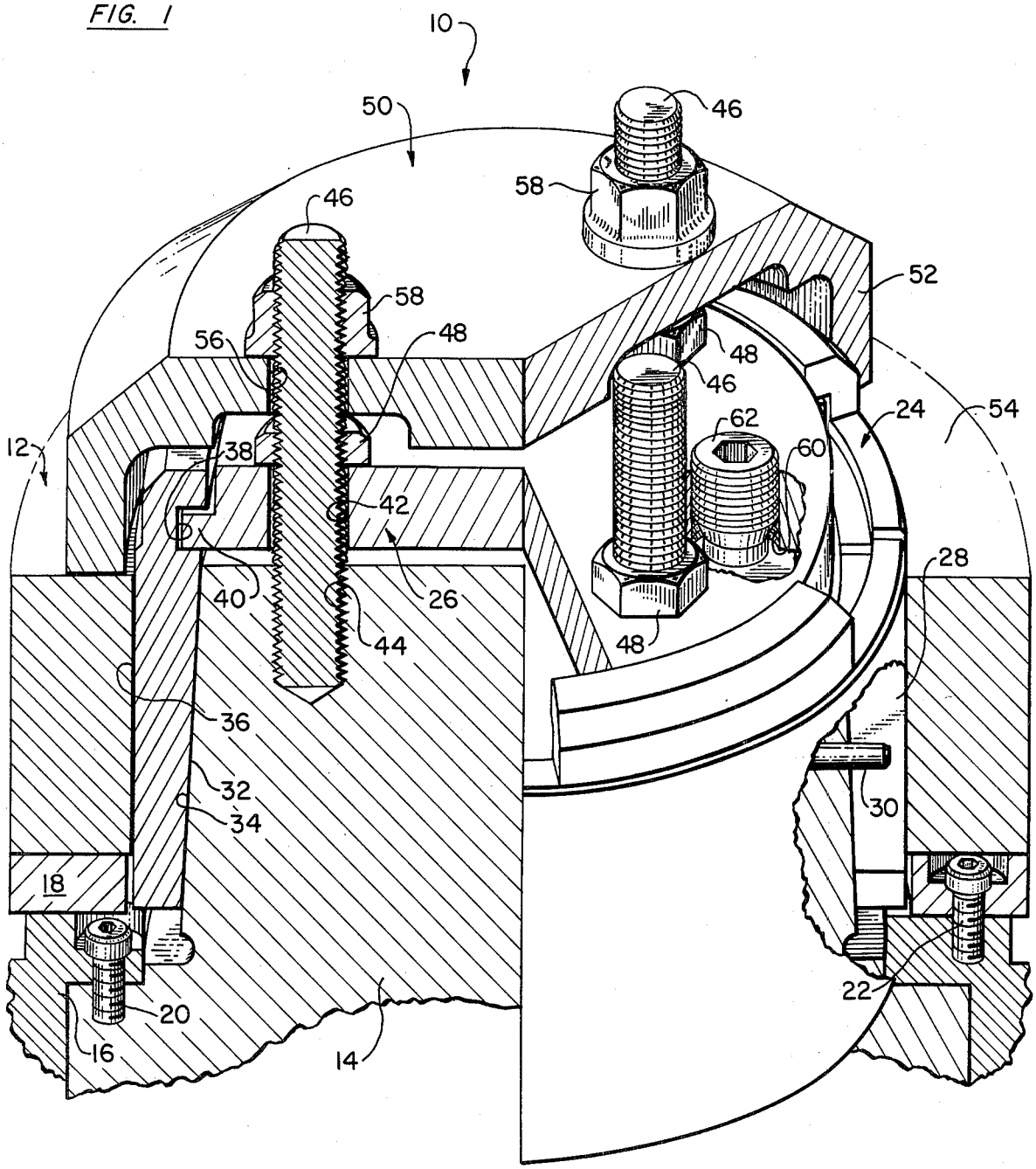
FIG. 1 is a pictorial view, partly broken away and partly in section, illustrating a circular die mounting assembly incorporating this invention.
Figure 3:
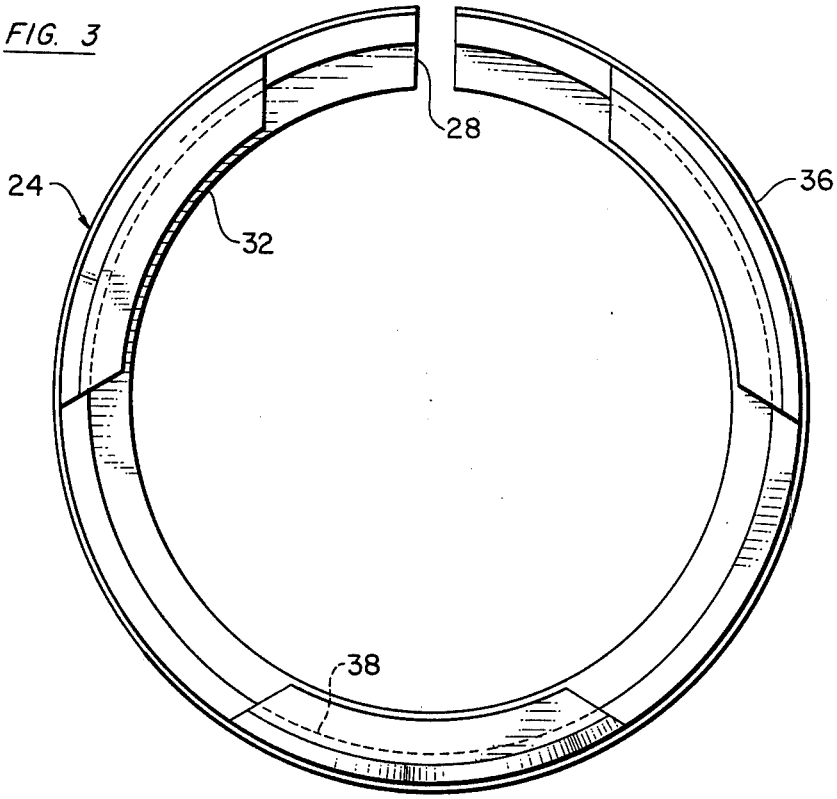
FIG. 3 is a top view of a wedging sleeve of the assembly.
Figure 2:
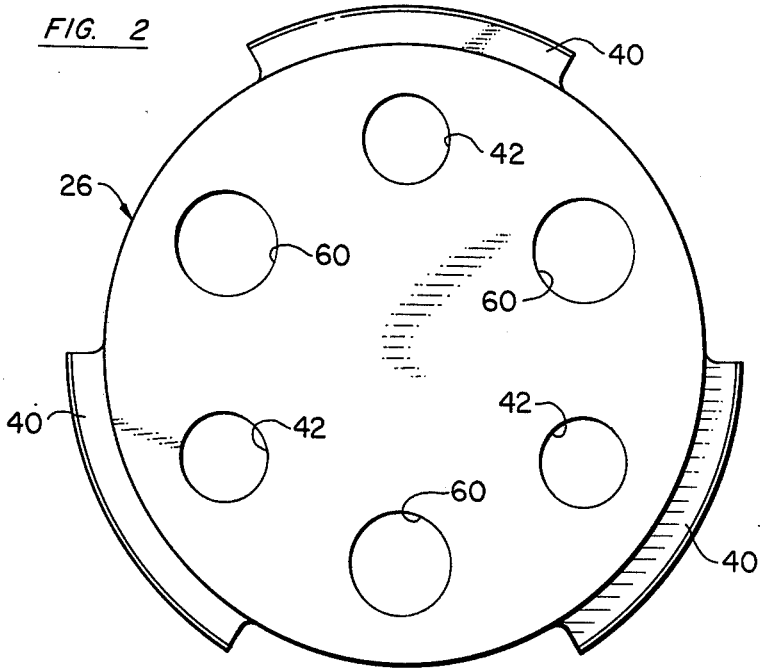
FIG. 2 is a top view of a jack plate of the assembly of FIG. 1.

Referring to the drawings in detail, it is to be understood that this invention is adapted to various types of machines. For purposes of this description, the invention is shown as applied to a planetary work forming machine of a type described in copending U.S. patent application Ser. No. 747,483 entitled "Planetary Work Forming Machine Having Improved Starter Timing Control and Starter Drive Selector" filed Dec. 6, 1976, now U.S. Pat. No. 4,088,054, and assigned to the assignee of this invention, the subject matter of which is incorporated herein by reference.

The assembly 10 of this invention includes a circular die 12 mounted for rotation about a fixed axis of an axially tapered machine spindle 14 rotatably mounted on a fixed machine frame, not shown. Circular die 12 may be of a thread rolling type wherein a fixed segmental die, not shown, is disposed radially outwardly in fixed relation to the rotatable circular die 12. As described in the above referenced patent application, upon wedging a work blank between the dies, friction between the blank and the dies causes the blank to roll in a planetary fashion about the fixed segmental die to form a thread rolled onto the periphery of the blank. The circular die 12 is accurately made, preferably by first having the die ground on an arbor after heat treating to provide a precision finished thread profile.

In the specifically illustrated embodiment, a pair of shoulder rings 16 and 18 are shown encircling spindle 14 and are attached thereto in stacked relation by suitable fasteners 20 and 22. Circular die 12 seats on the upper shoulder ring 18.

To preserve and enhance the concentricity of the circular die and eliminate minor radial die distortions or out-of-roundness, while at the same time removing any clearances between die 12 and spindle 14, a tapered sleeve 24 is provided with a releasable driving connection to a jack plate 26 to force the sleeve 24 axially into the space between die 12 and spindle 14. To permit diametrical expansion of the sleeve 24 as it is thrust into wedging engagement to remove all clearances between spindle 14 and the circular die 12, an axially extending slot 28 is shown formed in the sleeve 24. Multiple slots may also be provided at spaced intervals extending partially the axial length of the sleeve 24, if desired. A drive pin 30 is preferably secured to the spindle 14 to project radially outwardly into the slot 28 in sleeve 24. Sleeve 24 has an inside surface 32 of tapered diameter corresponding to the outer tapered surface 34 of the spindle 14, and the outside surface 36 of the sleeve 24 is cylindrical to provide a die engaging surface of substantially uniform diameter.

To provide a releasable direct driving connection to the jack plate 26, a circumferentially extending groove 38 is formed in the inside wall of sleeve 24 adjacent its upper end, and the upper end wall of the sleeve 24 is relieved at three equally spaced intervals to provide a symmetrically interrupted groove 38. The jack plate 26 is provided with three outwardly projecting radial flanges or tongues 40 which are formed symmetricaliy about the periphery of the jack plate 26 with each tongue 40 having an arcuate dimension slightly less than the relieved portions in the upper end wall of the sleeve 24 such that the jack plate 26 may be assembled in coaxial overlying relation to the spindle 14 with the jack plate tongues 40 disposed within the relieved sleeve portions and then rotated relative to the sleeve 24 to move the tongues 40 into registry with the grooves 38 to provide a bayonet-type coupling. So engaged, the tongues 40 of the jack plate 26 within the groove 38 provide a bi-directional drive connection between the jack plate 26 and sleeve 24. The jack plate 26 accordingly may be used to force the sleeve 24 down into the space between the spindle 14 and die 12 causing the sleeve 24 to diametrically expand and remove all clearances.

In the specifically illustrated embodiment, three equally spaced clearance holes 42 are formed in the jack plate 26 on a common diameter to match three coaxially aligned tapped openings such as at 44 in the top of the spindle for receiving suitable threaded fasteners such as the illustrated studs 46. The latter are shown threaded full length and are threadably engaged within the spindle openings 44. Jam nuts 48 are assembled on the studs 46 and with the tongue and groove driving connection engaged as shown in FIG. 1, rotation of the jam nuts 48 in a selected direction effects engagement with the jack plate 26 and continued tightening down of the jam nuts 48 forces the jack plate 26 to drive the sleeve 24 axially downwardly into its operating position illustrated in FIG. 1 in concentrically interposed wedged engagement between the spindle 14 and die 12 via the tongue and groove driving connection between the jack plate 26 and sleeve 24.

To effect positive seating of the circular die 12 against the shoulder ring 18, the preferred embodiment of this invention includes a clamp plate 50 which is in coaxially stacked overlying relation to the jack plate 26 and spindle 14 and has a generally cup-shaped configuration with a depending peripheral skirt 52 for engaging an upper end wall 54 of the circular die 12. The clamp plate 50 is provided with three equally spaced, symmetrically arranged clearance holes such as at 56 through which the studs 46 project. A flange nut 58 is assembled on each stud 46 to engage and hold down the clamp plate 50 with sufficient force to positively seat the circular die 12 against the ring 18 attached to spindle 14.

For quick and easy die removal or disassembly, the jack plate 26 is illustrated as having tapped openings 60 formed therein in equiangularly spaced relation to one another and symmetrically located between the clearance holes 42 through which the studs 46 extend, and a suitable jack screw, such as the illustrated dog point set screw 62, is threadably mounted in each tapped opening 60 of the jack plate 26 for engagement with the end of the spindle 14. Upon first removing the clamp plate 50 and loosening the three jam nuts 48, the three jack screws 62 may then be used to loosen the sleeve 24 via its drive connection with the jack plate 26 by rotating the jack screws 62 in a direction suitable to lift the jack plate 26 axially away from the spindle 14. Very little axial travel is required before all parts are loose and can be simply and readily lifted off manually. Thereafter, it is a simple and quick matter to reassemble the parts for subsequent operation.

By virtue of the above described assembly featuring the one-piece tapered sleeve, during assembly of the die, its concentricity is assured as the sleeve is forced into operating position and uniformly expands to remove all clearances between the spindle and die in a single step procedure.

As will be apparent to persons skilled in the art, various modifications, adaptations and variations of the foregoing specific disclosure can be made without departing from the teachings of this invention.

I claim:

1. For quick and easy removable mounting of a circular die in precise concentric coaxial surrounding relation to a machine spindle, a die mounting assembly comprising a one-piece sleeve movable toward and away from an operating position in concentrically interposed wedged engagement between the spindle and the surrounding circular die for removing clearances therebetween, and selectively operable bi-directional displacement means including a jack plate and a releasable tongue and groove bayonet-type direct driving coupling between the sleeve and the jack plate, the jack plate being in overlying relation to the spindle for moving the sleeve as a unit in opposite axial directions toward and away from its operating position.

2. The assembly of claim 1 wherein the bi-directional displacement means includes adjustable fastener means between the jack plate and spindle cooperating with said direct driving connection for selectively moving the jack plate to displace the sleeve in opposite axial directions.

3. The assembly of claim 1 wherein the bi-directional displacement means includes a plurality of equally circumferentially spaced tongues radially projecting from one of the sleeve and jack plate members, the other of the sleeve and jack plate members having a circumferentially extending groove interrupted at equally spaced intervals for receiving said tongues, the sleeve and jack plate members being relatively angularly displaceable with the tongues and grooves in registry with one another to provide a releasable bayonet-type coupling effecting a direct drive connection between the sleeve and the jack plate.

4. The assembly of claim 1 wherein the bi-directional displacement means further includes a screw extending through the jack plate and threadably connected to the spindle, a jam nut assembled on the screw to force the jack plate toward the spindle and to drive the sleeve axially between the spindle and the die, the sleeve being diametrically expandable to remove clearances between the spindle and the die upon being moved toward said operating position.

5. The assembly of claim 4 further including a jack screw threadably mounted in the jack plate for engaging the end of the spindle to force the jack plate away from the spindle and thereby drive the sleeve away from its operating position upon loosening said jam nut for quick and easy die removal.

6. The assembly of claim 5 further including a die engaging clamp plate in coaxially stacked overlying relation to the jack plate and die, said screw threadably connected to the spindle extending through both the jack plate and the clamp plate, and a second nut assembled on said screw in threaded engagement therewith to releasably secure the clamp plate in die seating engagement.

7. The assembly of claim 1 wherein the sleeve has a tapered inside diameter, corresponding to an axially tapered outside spindle diameter, and a die engaging cylindrical outer surface.

8. The assembly of claim 1 wherein the sleeve is provided with an axially extending slot to permit radial expansion, and wherein the drive pin is secured in the spindle to project into the slot in the sleeve.

* * * * *